US006134979A

United States Patent [19]

Thomas

[11] Patent Number: 6,134,979

[45] Date of Patent: Oct. 24, 2000

[54] ANTI-SAW-THROUGH SPRING GUIDE AND SPRING RETAINER

[75] Inventor: Craig A. Thomas, Marysville, Ohio

[73] Assignee: Siemens Energy & Automation, Inc., Alpharetta, Ga.

[21] Appl. No.: 09/335,326

[22] Filed: Jun. 17, 1999

[51] Int. Cl.[7] ..... H01H 5/06

[52] U.S. Cl. ..... 74/97.1; 200/401

[58] Field of Search ..... 74/10.7, 97.1; 200/401, 293, 416, 453; 267/169

[56] References Cited

U.S. PATENT DOCUMENTS 5,944,172 8/1999 Hannula ..... 200/401

*Primary Examiner*—Rodney H. Bonck
*Attorney, Agent, or Firm*—Ira Lee Zebrak

[57] ABSTRACT

A spring guide and spring retainer for switches or toggle mechanisms with cooperating curved surfaces to decrease the rate of wear.

18 Claims, 3 Drawing Sheets

ANTI-SAW-THROUGH SPRING GUIDE AND SPRING RETAINER

FIELD OF THE INVENTION

The present invention relates to switches or toggle mechanisms and, in particular, to an improved spring guide and spring retainer.

BACKGROUND OF THE INVENTION

As is typical of most switches and toggle mechanisms, as the switch or toggle mechanisms is operated, spring guides travel back and forth through a spring retainer. However, because of the forces involved in the operation of the switch or the toggle mechanism, the spring guides tend to be forced against the inner edge(s) of the retaining slot in the retainer. These forces cause a rubbing action of the spring guides against the spring retainer wearing the spring retainer and will, in a relatively short duty cycle, "saw through" the spring retainer resulting in the disabling of the function of the spring retainer. Referring to FIG. 1, a typical switch mechanism 10 is depicted with a rotor cam 12, spring guides 14, spring cam 16, retainer 18 and mechanism housing 20. Referring to FIG. 2, as spring guides 14 pass back and forth through spring retainer slot 22 in retainer 18, the spring guides are forced into contact with edge 23 of retainer slot 22 causing it to wear and eventually saw through the retainer. The prior art has no method or apparatus to prevent such saw through, or the spring guide was made as a single plastic member of circular cross section which produced complications in the design of the spring cam. Such complications required the spring cam to be a "U"-shaped member in order to retain the plastic circular cross section spring guide as contrasted to a flat stamped cam member to retain one flat stamped spring guide on each of its sides.

It would therefore be an advantage over the prior art designs to provide an arrangement and configuration which overcomes the above-stated disadvantages and which accomplishes the foregoing objective by providing a novel, simple, inexpensive and reliable spring guides and spring retainer combination.

SUMMARY OF THE INVENTION

In accordance with the present invention, a switch mechanism is provided comprising a mechanism housing, a rotor cam, a spring cam, a spring retainer having a retaining aperture comprising a first curved shape having a convex surface, and spring guides for passing through the retaining aperture in the spring retainer, the spring guides having a second curved shape.

In in accordance with another aspect of the present invention, the spring guides and/or the spring retainer is formed from cold rolled steel.

DETAILED DESCRIPTION OF THE INVENTION

Figure 1:
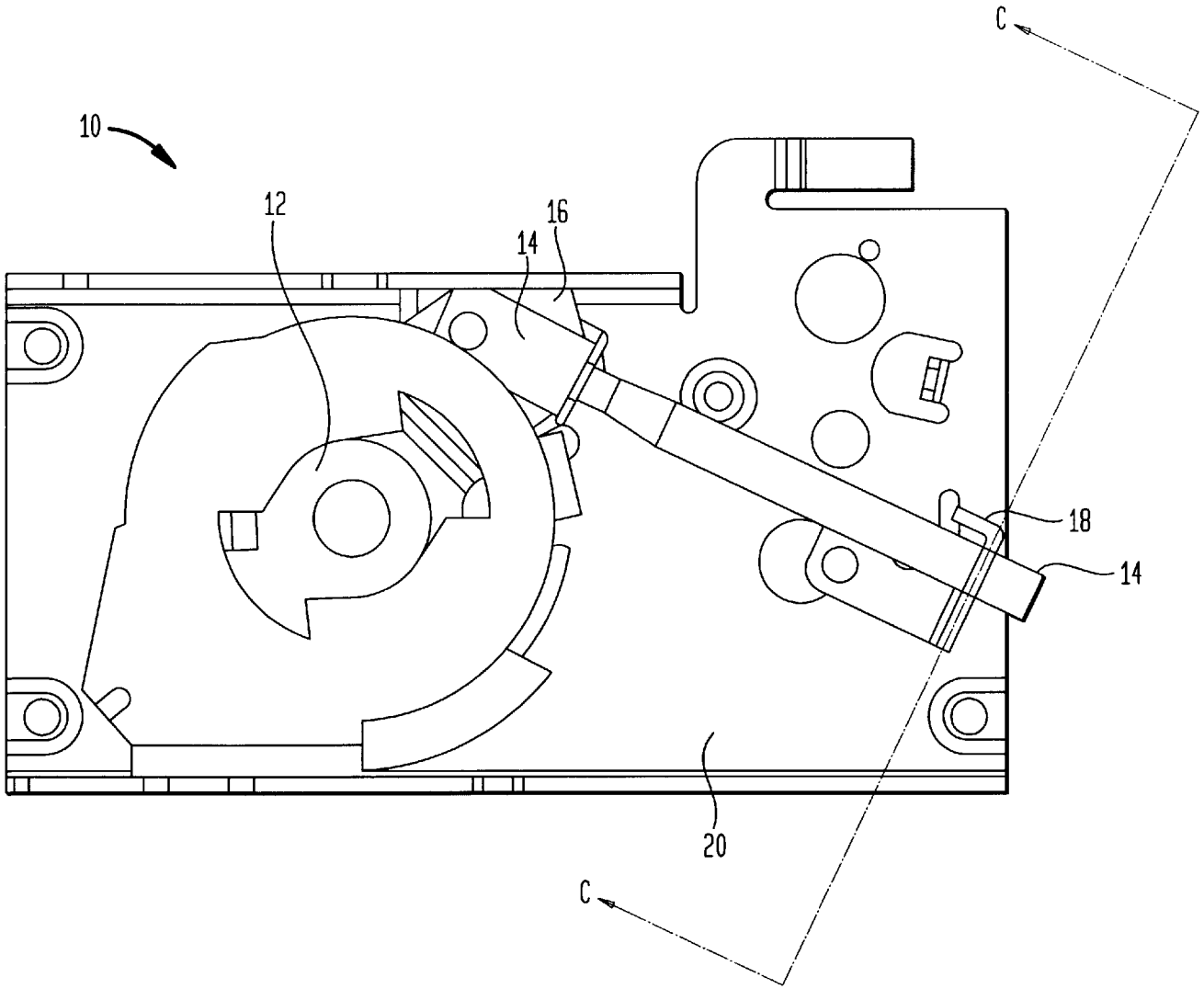
FIG. 1 is a schematic side view of a typical prior art switch mechanism.
Figure 2:
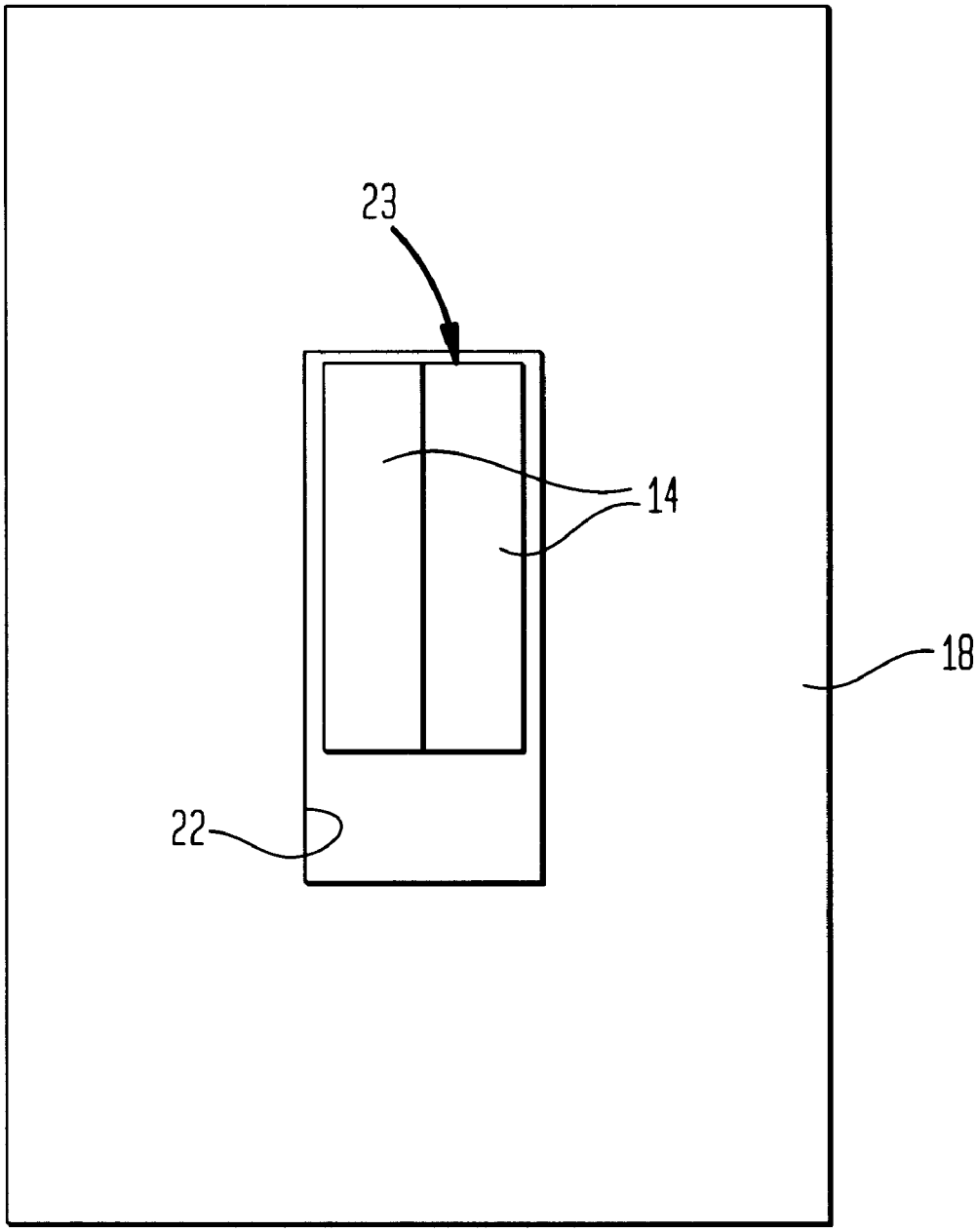
FIG. 2 is an enlarged sectional view taken along line c—c and showing the detail of the interaction between the spring guides and retainer of the switch mechanism show in FIG. 1.
Figure 3A:
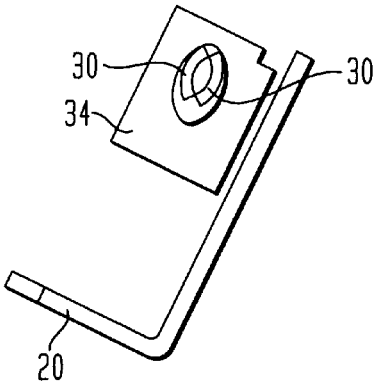
FIG. 3A is a sectional view of the switch mechanism shown in FIG. 1 but with the spring guides and spring retainer of the present invention.
Figure 3B:
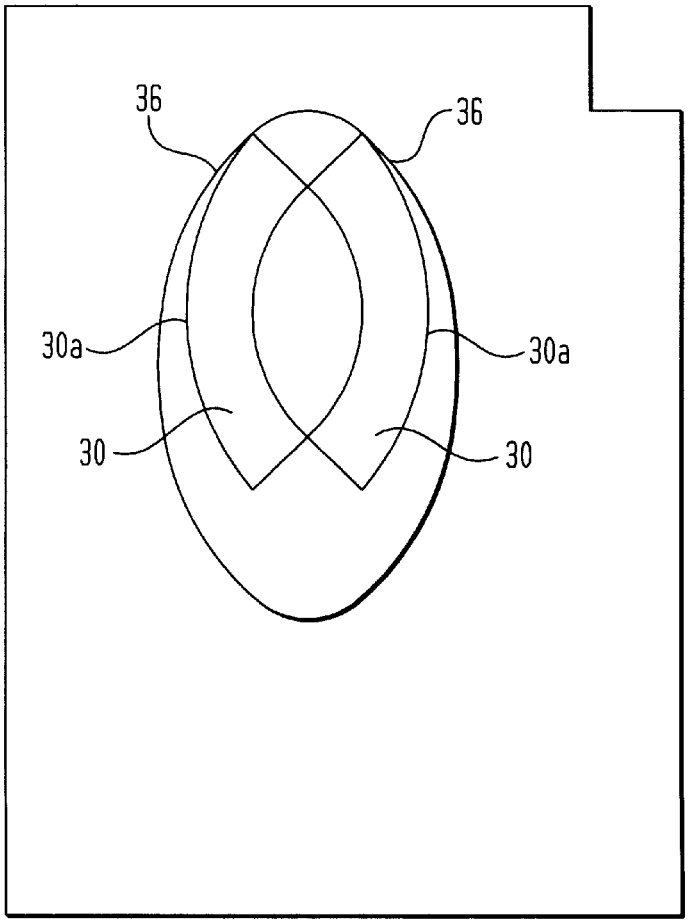
FIG. 3B is an enlarged view of the present invention showing the spring guides in the retaining aperture of the spring retainer.

Referring to FIG. 3A which shows a sectional view of the switch mechanism shown in FIG. 1 but with the spring guides and spring retainer of the present invention and FIG. 3B which is an enlarged view showing greater detail of the novel spring guides 30 of the present invention within the novel shaped retaining aperture 32 in a spring retainer 34. Spring guides 30 have a cross-sectional area of an arc of a circle and are stamped from metal to minimize costs of production. Retaining aperture 32 is similarly stamped from metal and has a shape of an oval to facilitate contact with a convex surface 30*a* of each spring guide 30.

By providing, in accordance with the present invention, a curved shape to the stamped metal spring guides and a corresponding curved shape to the retaining aperture 32 in spring retainer 34, and depending upon the particular chosen curvature of the spring guides, either a much higher surface area of contact 36 between the convex surface of the spring guide and the edges of the retaining aperture is soon obtained as the spring guides gradually wear as the switch repeatedly functions, or the curvature of the spring guides is so chosen so that the initial contact area between the spring guides and the retaining aperture is larger than the prior art. Because of this greater surface area of contact, the surface pressure between the spring guides and the spring retainer is lower, and thus the potential for "saw-through" is reduced. The shape of the spring guides and the aperture in the spring retainer is such that as wear occurs, the resulting area of contact will be larger than the prior art designs, and will increase as further wear increases, resulting in a decrease in the rate of wear of the spring retainer.

In a preferred embodiment the spring guides and/or the spring retainer is stamped from cold rolled steel.

While the foregoing description and drawings represent the preferred embodiments of the present invention, it will be apparent to those skilled in the art that various changes and modifications may be made therein without departing from the true spirit and scope of the present invention.

What is claimed is:

1. A switch mechanism comprising:

(a) a mechanism housing;

(b) a rotor cam;

(c) a spring cam;

(d) a spring retrainer having a retaining aperture comprising a first curved shape having a convex surface;

(e) spring guides for passing through the retaining aperture in the spring retainer, the spring guides having a second curved shape.

2. The switch mechanism as in claim 1 wherein the first curved shape of the retaining aperture having a convex surface is an arc of an oval.

3. The switch mechanism as in claim 2 wherein the second curved shape of at least one of the spring guides is an arc of a circle.

4. The switch mechanism as in claim 3 wherein at least one of the spring guides is formed from cold rolled steel.

5. The switch mechanism as in claim 4 wherein the spring retainer is formed of cold rolled steel.

6. The switch mechanism as in claim 2 wherein the first curved shape of the retaining aperture having a convex surface is an oval.

7. The switch mechanism as in claim 6 wherein the spring retainer is formed of cold rolled steel.

8. The switch mechanism as in claim 2 wherein at least one of the spring guides is formed from cold rolled steel.

9. The switch mechanism as in claim 8 wherein the spring retainer is formed of cold rolled steel.

10. The switch mechanism as in claim 1 wherein the second curved shape of at least one of the spring guides is an arc of a circle.

11. The switch mechanism as in claim 10 wherein the first curved shape of the retaining aperture having a convex surface is an oval.

12. The switch mechanism as in claim 11 wherein at least one of the spring guides is formed from cold rolled steel.

13. The switch mechanism as in claim 12 wherein the spring retainer is formed of cold rolled steel.

14. The switch mechanism as in claim 10 wherein at least one of the spring guides is formed from cold rolled steel.

15. The switch mechanism as in claim 14 wherein the spring retainer is formed of cold rolled steel.

16. The switch mechanism as in claim 1 wherein the first curved shape of the retaining aperture having a convex surface is an oval.

17. The switch mechanism as in claim 16 wherein at least one of the spring guides is made from cold rolled steel.

18. The switch mechanism as in claim 17 wherein the spring retainer is formed of cold rolled steel.

* * * * *